US012492851B2

(12) United States Patent
Cha et al.

(10) Patent No.: US 12,492,851 B2
(45) Date of Patent: Dec. 9, 2025

(54) ACCUMULATOR AND A HEAT PUMP SYSTEM WITH THE SAME

(71) Applicants: HYUNDAI MOTOR COMPANY, Seoul (KR); KIA CORPORATION, Seoul (KR)

(72) Inventors: Yong Woong Cha, Yongin-si (KR); Jungha Park, Gunpo-si (KR); Seong-Bin Jeong, Hwaseong-si (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 121 days.

(21) Appl. No.: 18/523,199

(22) Filed: Nov. 29, 2023

(65) Prior Publication Data

US 2025/0085038 A1 Mar. 13, 2025

(30) Foreign Application Priority Data

Sep. 11, 2023 (KR) ..... 10-2023-0120425

(51) Int. Cl.
*F25B 43/00* (2006.01)

(52) U.S. Cl.
CPC ..... *F25B 43/006* (2013.01); *F25B 2500/16* (2013.01)

(58) Field of Classification Search
CPC ..... F25B 43/006; F25B 2500/16
See application file for complete search history.

(56) References Cited

U.S. PATENT DOCUMENTS

| | | | | |
|---|---|---|---|---|
| 4,276,756 A * | 7/1981 | Livesay | ..... | F25B 43/006 62/298 |
| 5,282,370 A * | 2/1994 | Kiblawi | ..... | F25B 43/006 138/44 |
| 2024/0247846 A1* | 7/2024 | Higashiiue | ..... | F25B 43/006 |

* cited by examiner

*Primary Examiner* — Elizabeth J Martin
(74) *Attorney, Agent, or Firm* — Lempia Summerfield Katz LLC

(57) ABSTRACT

An accumulator includes a body having an upper body and a lower body. The upper body and lower body are coupled with each other to have a chamber in the body. The accumulator includes: a refrigerant inlet port disposed on the upper body and allowing a mixed refrigerant of a liquid refrigerant and a gaseous refrigerant to flow into the chamber; a refrigerant outlet port disposed on the upper body and allowing the gaseous refrigerant separated from the liquid refrigerant to flow out; and a baffle assembly having a vertical baffle being vertically disposed in the chamber to impede a horizontal flow of the liquid refrigerant, a suction pipe guiding the gaseous refrigerant separated from the liquid refrigerant to the refrigerant outlet port, and a horizontal baffle being horizontally disposed in the chamber to impede a vertical flow of the liquid refrigerant.

18 Claims, 7 Drawing Sheets

ACCUMULATOR AND A HEAT PUMP SYSTEM WITH THE SAME

CROSS-REFERENCE TO RELATED APPLICATION

This application claims priority to and the benefit of Korean Patent Application No. 10-2023-0120425, filed Sep. 11, 2023, the entire contents of which are incorporated herein by reference.

BACKGROUND

(a) Field of the Disclosure

The present disclosure relates to an accumulator and a heat pump system with the same. More particularly, the present disclosure relates to an accumulator which may separate a gaseous refrigerant from a mixed refrigerant of a liquid refrigerant and supply the gaseous refrigerant to a compressor. Additionally, the present disclosure relates to a heat pump system with the same.

(b) Description of the Related Art

An accumulator may be mainly used in a heat pump system. In particular, because an accumulator used in a vehicle heat pump system may be exposed to various environments, an accumulator made of aluminum may be mainly used in the system in consideration of its pressure resistance, durability, and corrosion resistance. In addition, a fixing bracket may be used to mount the aluminum accumulator to a vehicle. The accumulator and its related parts may be fixed to the vehicle by a method such as welding. Accordingly, fixing the accumulator and its related parts to the vehicle becomes more difficult.

In addition, the aluminum accumulator may have a large weight, which may also lead to an increased weight of the fixing bracket for fixing the accumulator. Therefore, an overall load of the vehicle may be increased, which may reduce the fuel efficiency or all-electric range (AER) of the vehicle.

The aluminum accumulator may transfer heat between a refrigerant therein and an external environment, which may reduce the performance of the heat pump system. In addition, the part of the accumulator may have a limited shape, thus making oil circulation difficult, which may lower the durability of a compressor.

The above information disclosed in this Background section is provided only to assist in understanding of the background of the present disclosure, and may thus include information not included in the prior art already known to those having ordinary skill in the art to which the present disclosure pertains.

SUMMARY

The present disclosure provides an accumulator made of plastic, which may reduce heat transfer between a refrigerant therein and an external environment.

The present disclosure also provides a heat pump system with an accumulator to increase fuel efficiency or an all-electric range (AER) of a vehicle.

According to an embodiment, an accumulator includes a body including an upper body disposed on an upper side and a lower body disposed on a lower side. The upper body and the lower body are coupled with each other to have a chamber in the body. The accumulator also includes a refrigerant inlet port disposed on the upper body and configured to allow a mixed refrigerant of a liquid refrigerant and a gaseous refrigerant to flow into the chamber. The accumulator also includes a refrigerant outlet port disposed on the upper body and configured to allow the gaseous refrigerant separated from the liquid refrigerant to flow out. Additionally, the accumulator includes a baffle assembly disposed in the chamber, configured to impede a flow of the liquid refrigerant, and coupled to the body.

In one embodiment, the baffle assembly may include: a vertical baffle vertically disposed in the chamber and configured to impede a horizontal flow of the liquid refrigerant; a suction pipe configured to guide the gaseous refrigerant separated from the liquid refrigerant to the refrigerant outlet port; and a horizontal baffle horizontally disposed in the chamber and configured to impede a vertical flow of the liquid refrigerant.

In one embodiment, the horizontal baffle may separate the chamber into an upper chamber and a lower chamber. A filter may be disposed in the horizontal baffle, configured to filter foreign material in the refrigerant, and configured to fluidly communicate the upper chamber with the lower chamber.

In another embodiment, the suction pipe may include a suction pipe inlet through which the gaseous refrigerant flows into the suction pipe, and a suction pipe outlet through which the gaseous refrigerant is discharged to the refrigerant outlet port. The suction pipe inlet and the suction pipe outlet may be disposed in the upper chamber, and the suction pipe may extend downward from the suction pipe inlet to the lower chamber, and extend upward again to the suction pipe outlet disposed in the upper chamber.

In one embodiment, a guide may be disposed around the suction pipe inlet and configured to prevent the liquid refrigerant from flowing into the suction pipe.

An outlet end of the refrigerant inlet port may be disposed to be lower than the suction pipe inlet.

A desiccant may be mounted on an upper surface of the horizontal baffle.

In one embodiment, the vertical baffle includes a vertical baffle plate that may have first and second grooves formed in an upper end portion, spaced apart from each other, and each having an open upper portion. The refrigerant inlet port may be inserted into the first groove, and the refrigerant outlet port may be inserted into the second groove.

A bottom surface of the first groove may include an inclined surface.

A bottom surface of the second groove may be connected to the suction pipe, such that the suction pipe is inserted into the refrigerant outlet port.

In one embodiment, at least one through hole may be formed in the vertical baffle.

An oil orifice may be provided at a lower portion of the suction pipe, and may be configured to fluidly communicate with a lower portion of the lower chamber.

The body and the baffle assembly may each be made of plastic.

The vertical baffle and the suction pipe may be integrated with each other and coupled to the horizontal baffle.

The vertical baffle and the suction pipe integrated with each other may be manufactured as first and second vertical baffles and then coupled with each other.

The horizontal baffle may be coupled to a portion where the upper body and lower body are coupled with each other.

According to another embodiment, a heat pump system includes an evaporator configured to evaporate a refrigerant, and an accumulator configured to receive a mixed refrigerant of a liquid refrigerant and a gaseous refrigerant from the evaporator, and separate the gaseous refrigerant from the mixed refrigerant. The system also includes a compressor configured to receive the gaseous refrigerant from the accumulator and compress the gaseous refrigerant. The accumulator includes a body having an upper body disposed on an upper side and a lower body disposed on a lower side. The upper body and the lower body are coupled with each other to have a chamber in the body, The accumulator also includes a refrigerant inlet port disposed on the upper body and configured to allow a mixed refrigerant of a liquid refrigerant and a gaseous refrigerant to flow into the chamber. The accumulator also includes a refrigerant outlet port disposed on the upper body and configured to allow the gaseous refrigerant separated from the liquid refrigerant to flow out. Additionally, the accumulator includes a baffle assembly disposed in the chamber, configured to impede a flow of the liquid refrigerant, and coupled to the body.

A refrigerant inlet port may be connected to the evaporator, and a refrigerant outlet port may be connected to the compressor.

As set forth above, the accumulator according to the present disclosure may be made of plastic to reduce the heat transfer between the refrigerant therein and the external environment. It is thus possible to reduce the temperature and pressure fluctuations in the heat pump system, thereby easily controlling the temperature and the pressure, and improving the performance of the system. In addition, the accumulator may be made of plastic, which may reduce its weight, thereby improving the fuel efficiency and an all-electric range (AER) of the vehicle.

The baffle assembly may prevent the excessive movement of the liquid refrigerant that occurs due to the vehicle movement, thereby preventing the liquid refrigerant from flowing into the compressor.

In addition, the gaseous refrigerant supplied to the compressor may include oil to prevent the compressor from failing.

Other effects which may be obtained or predicted by the embodiments of the present disclosure are disclosed directly or implicitly in the detailed description of the embodiments of the present disclosure. Various effects predicted based on the embodiments of the present disclosure are disclosed in the detailed description described below.

BRIEF DESCRIPTION OF THE DRAWINGS

Embodiments in the specification may be better understood by referring to the following description in connection with the accompanying drawings in which like reference numerals refer to identical or functionally similar elements.

Figure 1:
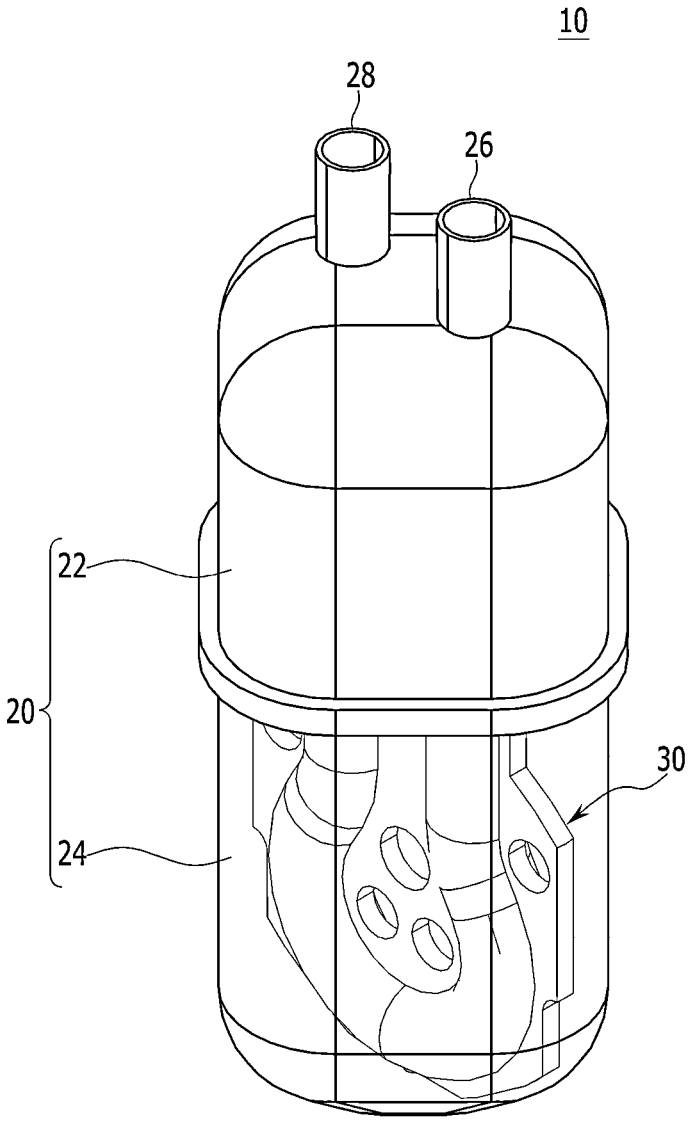
FIG. 1 is a schematic perspective view of an accumulator according to an embodiment of the present disclosure, which transparently shows a lower body of the accumulator.

It should be understood that the drawings referenced above are not necessarily drawn to scale, and present a rather simplified representation of various features illustrating the basic principles of the present disclosure. For example, specific design features of the present disclosure, including a specific dimension, orientation, position, and shape, are determined in part by the particularly intended application and environment of use.

DETAILED DESCRIPTION

A term used herein is only to describe a specific embodiment and is not intended to limit the present disclosure. A term of a singular number used herein is intended to include its plural number unless the context clearly indicates otherwise. It should also be understood that the terms "include" and/or "including," when used in the specification, specify the presence of the recited features, integers, steps, operations, elements, and/or components, and do not exclude the presence or addition of one or more of other features, integers, steps, operations, elements, elements, components and/or groups thereof. A term "and/or" used herein includes any one or all combinations of the associated listed items.

When a component, device, element, or the like of the present disclosure is described as having a purpose or performing an operation, function, or the like, the component, device, or element should be considered herein as being "configured to" meet that purpose or perform that operation or function.

According to the present disclosure, an accumulator may include: a body including an upper body and a lower body coupled with each other to have a chamber therein. The accumulator may also include a baffle assembly including a vertical baffle vertically disposed in the chamber to impede a horizontal flow of a liquid refrigerant, a suction pipe guiding a gaseous refrigerant separated from the liquid refrigerant to an outside, and a horizontal baffle horizontally disposed in the chamber to impede a vertical flow of the liquid refrigerant. The baffle assembly is coupled to the body. The body and the baffle assembly may each be made of plastic. Therefore, heat transfer between the inside and the outside of the accumulator may be reduced, which may reduce temperature and pressure fluctuations in a heat pump system. It is thus possible to easily control the temperature and the pressure in the heat pump system and improve the performance of the system. In addition, most or all parts of the accumulator may be made of plastic, thus making its manufacturing and assembly easier, which may reduce its production cost and weight, thereby improving fuel efficiency and all-electric range (AER) of a vehicle.

The horizontal baffle may physically separate the chamber into an upper chamber and a lower chamber. The suction pipe may include a suction pipe inlet and a suction pipe outlet both disposed in the upper chamber, extend downward from the suction pipe inlet to the lower chamber, and extend upward again therefrom to the suction pipe outlet disposed in the upper chamber. An oil orifice may be provided at a lower portion of the suction pipe, especially at the lowermost end, and communicate with a lower portion of the lower chamber. The gaseous refrigerant in the upper chamber may flow into the suction pipe through the suction pipe inlet and be moved from the upper chamber to the lower chamber and then again to the upper chamber in the suction pipe. In this process, oil in the lower chamber may be mixed with the gaseous refrigerant through the oil orifice. The gaseous refrigerant mixed with the oil may be supplied to a compressor, thus preventing a compressor failure.

Hereinafter, the present disclosure is described in detail with reference to the accompanying drawings.

Figure 2:
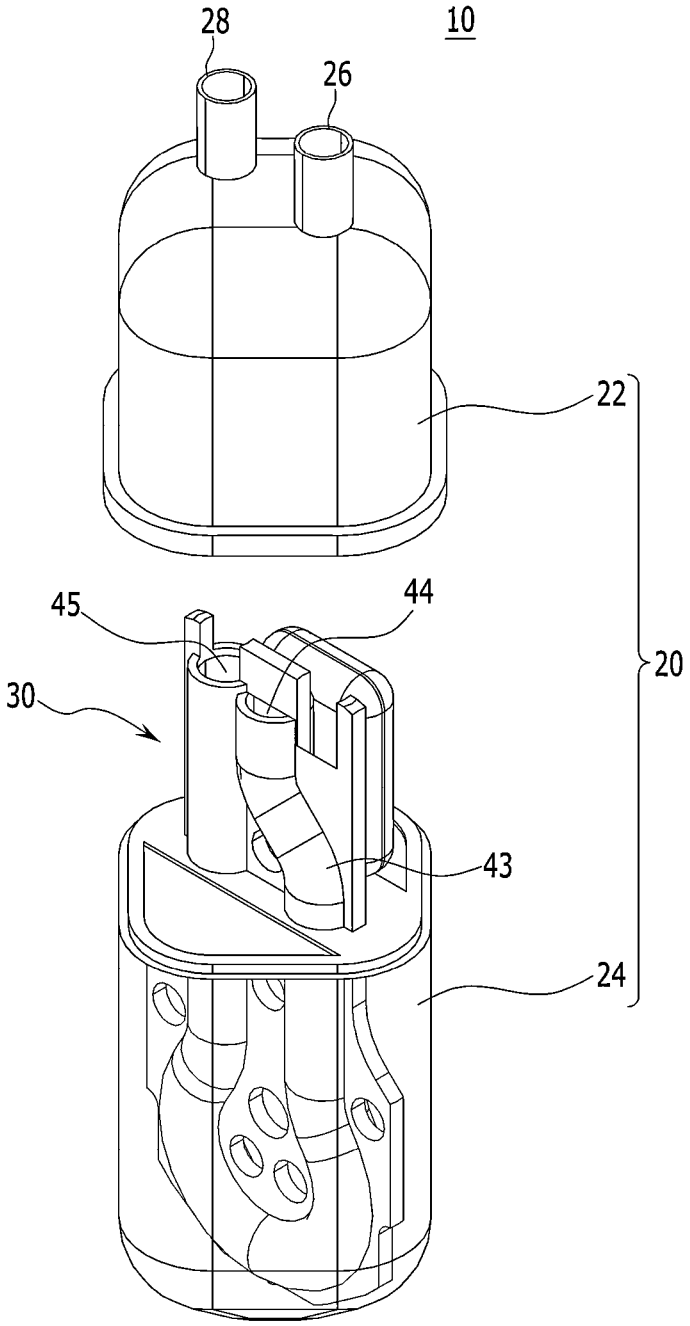
FIG. 2 shows an exploded view of an accumulator where an upper body is separated from the accumulator of FIG. 1.
Figure 3:
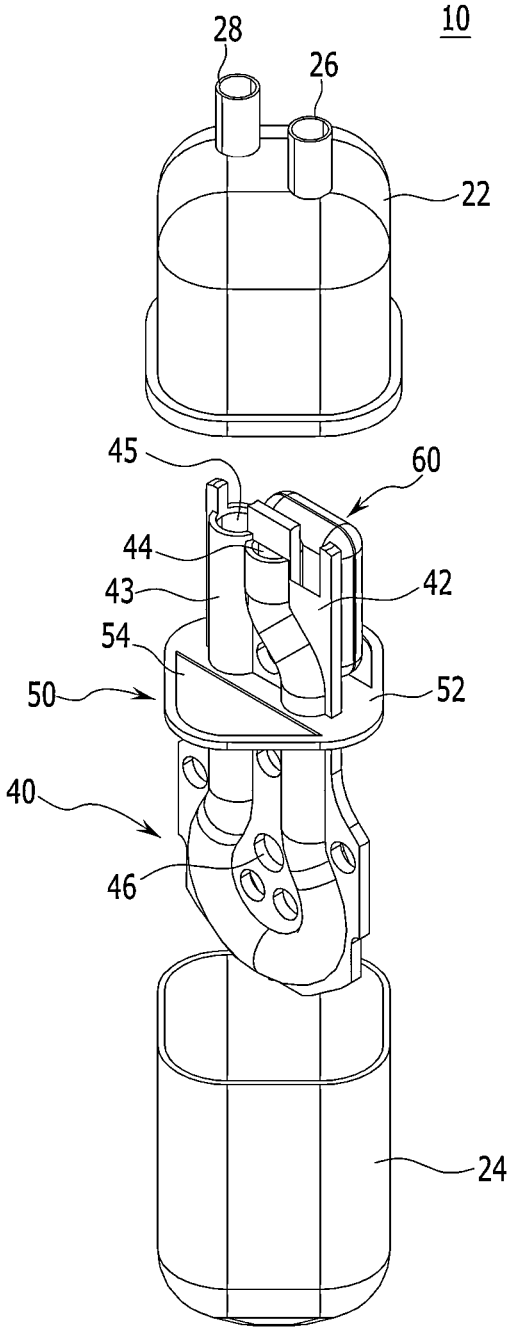
FIG. 3 shows an exploded view of an accumulator where a lower body is separated from the accumulator of FIG. 2.
Figure 4:
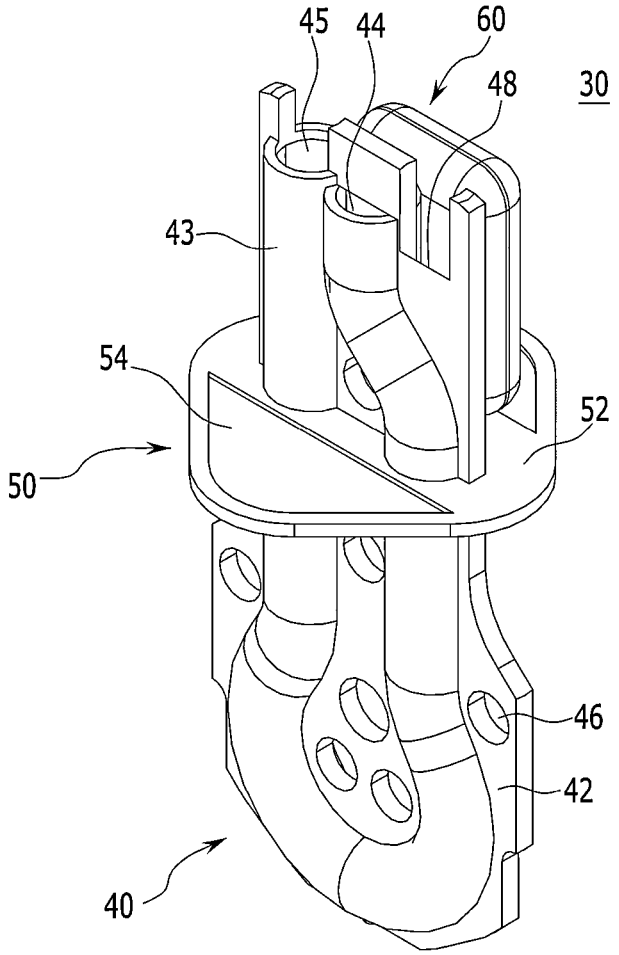
FIG. 4 is a perspective view of a baffle assembly according to an embodiment of the present disclosure.
Figure 5:
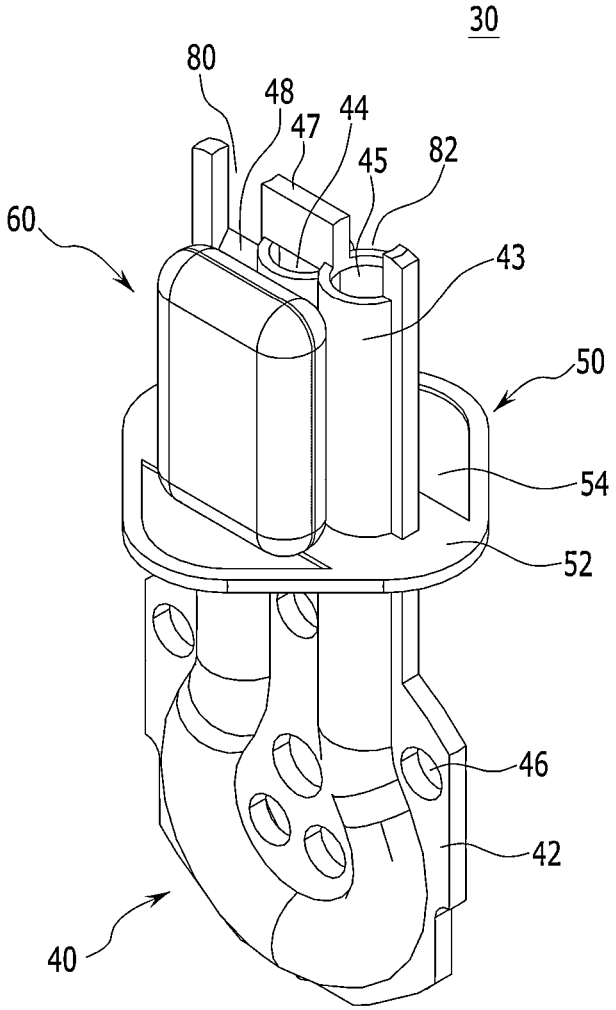
FIG. 5 is a perspective view of another baffle assembly according to an embodiment of the present disclosure.
Figure 6:
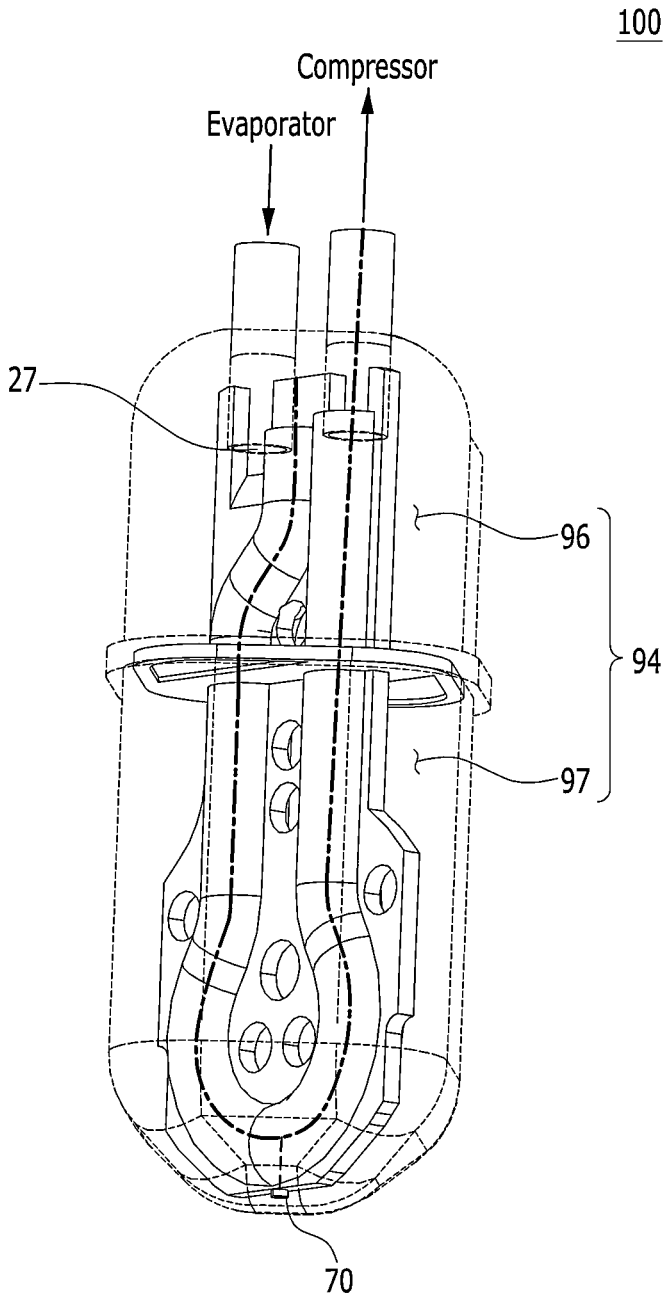
FIG. 6 shows a flow path of a refrigerant between an evaporator, a compressor, and an accumulator of a heat pump system.

FIG. 1 is a schematic perspective view of an accumulator according to an embodiment of the present disclosure, which transparently shows a lower body of the accumulator. FIG. 2 shows an exploded view of an accumulator where an upper body is separated from the accumulator of FIG. 1. FIG. 3 shows an exploded view of an accumulator where a lower body is separated from the accumulator of FIG. 2. FIG. 4 is a perspective view of a baffle assembly according to an embodiment of the present disclosure. FIG. 5 is a perspective view of another baffle assembly according to an embodiment of the present disclosure. FIG. 6 shows a flow path of a refrigerant between an evaporator, a compressor, and an accumulator of a heat pump system.

As shown in FIGS. 1 to 3, an accumulator 10 according to an embodiment of the present disclosure may include a body 20 and a baffle assembly 30. The body 20 and the baffle assembly 30 may each be made of plastic. In more detail, parts configuring the body 20 and the baffle assembly 30 may be manufactured using a plastic manufacturing method and joined with each other by using a plastic joining method. The plastic manufacturing method may be injection molding, insert molding, or the like, but is not limited thereto. Likewise, the plastic joining method may include fitting, adhesion, fusion, or the like, but is not limited thereto. Any method known to those having ordinary skill in the art to date may be applied as long as these methods are the methods of manufacturing and joining the body 20 and the baffle assembly 30 of plastic that may perform functions of the present disclosure. The body 20 and the baffle assembly 30, configuring the accumulator 10, may be made of plastic and coupled with each other. As a result, the configuration reduces heat transfer between an inside and an outside of the accumulator 10 and reduces temperature and pressure fluctuations in the heat pump system. It is thus possible to easily control the temperature and the pressure in the heat pump system and improve the performance of the system. In addition, the body 20 and the baffle assembly 30, configuring the accumulator 10, may be made of plastic and coupled with each other, thus making its manufacturing and assembly easier. As a result, the configuration reduces production cost and weight, thereby improving the fuel efficiency and all-electric range (AER) of the vehicle.

The body 20 may include an upper body 22 disposed on its upper side and a lower body 24 disposed on its lower side. The upper body 22 and the lower body 24 may each be made of plastic, and be coupled to each other by fusion, fitting, or adhesion to have a chamber 94 (see FIG. 6) provided therein. In more detail, a lower portion of the upper body 22 may be open and its interior may be empty, and an upper portion of the lower body 24 may be open and its interior may be empty. A lower end of the upper body 22 and an upper end of the lower body 24 may be coupled with each other by fusion, fitting, or adhesion to have the chamber 94 provided in the body 20. The baffle assembly 30 may be disposed in the chamber 94.

A refrigerant inlet port 26 and a refrigerant outlet port 28 may be disposed on the upper body 22. Specifically, the refrigerant inlet port 26 and the refrigerant outlet port 28 may be disposed on an upper surface of the upper body 22. An inlet end of the refrigerant inlet port 26 may be disposed outside the body 20, and the refrigerant inlet port 26 may extend into the upper body 22. An outlet end 27 (see FIG. 6) of the refrigerant inlet port 26 may be disposed in the body 20, i.e., in the chamber 94. An inlet end of the refrigerant outlet port 28 may be disposed in the body 20, i.e., in the chamber 94, and the refrigerant outlet port 28 may extend outside the upper body 22. An outlet end of the refrigerant outlet port 28 may be disposed outside the body 20. The refrigerant inlet port 26 and the refrigerant outlet port 28 may be integrated with the upper body 22 or may be manufactured separately from the upper body 22 and then coupled to the upper body 22.

As shown in FIG. 6, the refrigerant inlet port 26 may be connected to an evaporator. The evaporator may evaporate a refrigerant, and the refrigerant supplied from the evaporator to the refrigerant inlet port 26 may be a mixed refrigerant including a gaseous refrigerant and a liquid refrigerant. In other words, the refrigerant inlet port 26 may receive the mixed refrigerant of the liquid refrigerant and the gaseous refrigerant from the evaporator. The refrigerant outlet port 28 may be connected to a compressor. The accumulator 10 may separate the gaseous refrigerant from the mixed refrigerant received from the evaporator, and transfer the separated gaseous refrigerant to the compressor through the refrigerant outlet port 28. The compressor may compress the gaseous refrigerant received from the accumulator 10.

As shown in FIGS. 1 to 5, the baffle assembly 30 may be disposed in the chamber 94, and fixed to the body 20 to prevent excessive movement of the liquid refrigerant that occurs due to vehicle movement. For example, if the baffle assembly 30 is not disposed in the chamber 94, the liquid refrigerant in the chamber 94 may slosh around or may splash in a severe case when the vehicle is rapidly moved. To solve this problem, the baffle assembly 30 may be disposed in the chamber 94 to prevent the excessive movement of the liquid refrigerant that occurs due to the vehicle movement, thereby reducing a possibility of the liquid refrigerant being supplied to the compressor. The baffle assembly 30 may be made of plastic, and include a vertical baffle 40, a suction pipe 43, and a horizontal baffle 50 coupled to one another.

The vertical baffle 40 may be generally vertically disposed in the chamber 94 to impede a horizontal flow of the liquid refrigerant in the chamber 94. The vertical baffle 40 may include a vertical baffle plate 42 generally vertically disposed therein. The vertical baffle plate 42 horizontally divides the chamber 94 into a chamber on one side and a chamber on the other side. The vertical baffle 40 may prevent the excessive movement of the liquid refrigerant that occurs due to the vehicle movement by suppressing the movement of the liquid refrigerant between the chamber on one side and the chamber on the other side.

In one example, at least a portion of the vertical baffle plate 42 may be fused, adhered, or fitted to an inner peripheral surface of the body 20. The other portion may be spaced apart from the inner peripheral surface of the body 20. Therefore, the vertical baffle plate 42 may not completely restrict the movement of the liquid refrigerant between the chamber on one side and the chamber on the other side. In another example, the vertical baffle plate 42 may not be coupled to the inner peripheral surface of the body 20. In addition, at least one through hole 46 may be formed in the vertical baffle plate 42. The through hole 46 may allow movement of the refrigerant between the chamber on one side and the chamber on the other side, thus preventing the refrigerant from gathering in only one chamber on one side or another chamber on the other side.

The vertical baffle plate 42 may have first and second grooves 80 and 82 formed in an upper end portion of the vertical baffle plate 42. The first groove 80 may have an open upper end, and a bottom surface on which an inclined surface 48 is disposed sharply upward. As shown in FIG. 6, the outlet end 27 of the refrigerant inlet port 26 may be inserted into the first groove 80 to thus discharge the refrigerant (i.e., mixed refrigerant) to the inclined surface 48. The refrigerant discharged to the inclined surface 48 may be dispersed into the chamber on one side and the chamber on the other side by the inclined surface 48. It is thus possible to prevent the refrigerant discharged from the outlet end 27 of the refrigerant inlet port 26 from scattering or splashing by the inclined surface 48, thereby preventing the liquid refrigerant from flowing into the suction pipe 43. The second groove 82 may be spaced apart from the first groove 80 and have an open upper portion. The inlet end of the refrigerant outlet port 28 may be inserted into the second groove 82. A guide 47 may be disposed between the first and second grooves 80 and 82.

The horizontal baffle 50 may be substantially horizontally disposed in the chamber 94 to impede a vertical flow of the liquid refrigerant in the chamber 94. The horizontal baffle 50 may include a horizontal baffle plate 52 generally horizontally disposed therein, and the horizontal baffle plate 52 may separate the chamber 94 into an upper chamber 96 and a lower chamber 97. The horizontal baffle plate 52 may be coupled to the vertical baffle 40. In one example, the horizontal baffle plate 52 may have a groove formed therein and corresponding to a cross-section of the vertical baffle 40. The vertical baffle 40 may be inserted into the groove and then adhered or fused to the horizontal baffle plate 52.

An edge of the horizontal baffle plate 52 may be coupled to the inner peripheral surface of the body 20 by fusion, adhesion, or fitting. To this end, the horizontal baffle plate 52 may have the same shape as the inner peripheral surface of the body 20 at a specific position, and the chamber 94 may be physically separated into the upper chamber 96 and the lower chamber 97 by the horizontal baffle plate 52. In one example, the horizontal baffle 50 may be coupled to a portion where the upper body 22 and the lower body 24 are coupled with each other. Accordingly, when coupling the upper body 22 with the lower body 24, the baffle assembly 30 may also be coupled together between the upper body 22 and the lower body 24. Alternatively, the baffle assembly 30 may be coupled to one of the upper body 22 and the lower body 24, and the other one of the upper body 22 and the lower body 24 may then be coupled to the one of the upper body 22 and the lower body 24.

At least one filter 54 may be disposed in the horizontal baffle plate 52. The drawing shows that a pair of filters 54 is provided, and the number of filters 54 is not limited to two. The filter 54 may include a plurality of fine holes, which communicate the upper chamber 96 with the lower chamber 97. The filter 54 may also filter foreign material in the refrigerant moved from the upper chamber 96 to the lower chamber 97 through the filter 54. It is thus possible to prevent the foreign material from flowing into the lower chamber 97. In addition, the filter 54 may disperse the liquid refrigerant ejected from the refrigerant inlet port 26 to the filter 54 to prevent the liquid refrigerant from scattering or splashing. It is thus possible to minimize the inflow of the liquid refrigerant and the inflow of the foreign material into the suction pipe 43.

A desiccant 60 may be mounted on an upper surface of the horizontal baffle 50. In other words, the desiccant 60 may be disposed in the upper chamber 96. The desiccant 60 may absorb moisture contained in the gaseous refrigerant in the chamber 94, especially in the upper chamber 96. The desiccant may remove moisture in the gaseous refrigerant supplied to the compressor. It is thus possible to prevent performance deterioration of the heat pump system.

The suction pipe 43 may be integrated with the vertical baffle 40, or may be manufactured separately from the vertical baffle 40 and then coupled to the vertical baffle 40.

Figure 7:
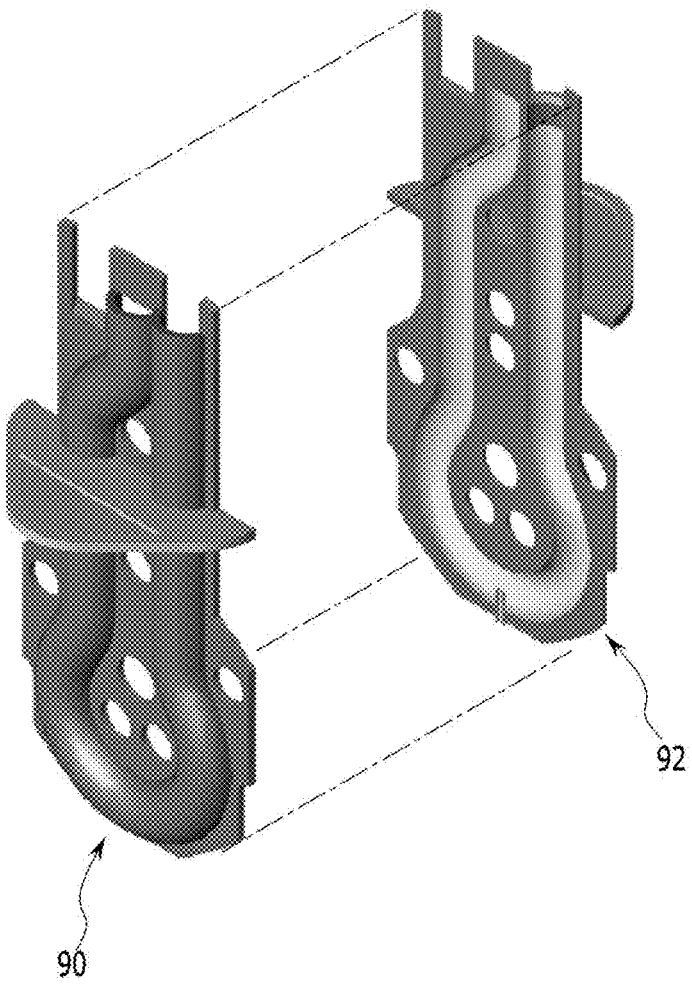
FIG. 7 is an exploded view of a baffle assembly according to another embodiment of the present disclosure.

In one example, as shown in FIG. 7, it is possible to manufacture one half of the baffle assembly 30 by manufacturing a first vertical baffle 90 in which one half of the suction pipe 43 and one half of the vertical baffle 40 are integrated with each other, and then coupling one half of the horizontal baffle 50 to the first vertical baffle 90. In addition, it is possible to manufacture the other half of the baffle assembly 30 by manufacturing a second vertical baffle 92 in which the other half of the suction pipe 43 and the other half of the vertical baffle 40 are integrated with each other, and then coupling the other half of the horizontal baffle 50 to the second vertical baffle 92. The baffle assembly 30 may be produced by coupling the one half of the baffle assembly 30 and the other half of the baffle assembly 30 with each other.

In another example, it is possible to manufacture the vertical baffle 40 having the suction pipe 43 integrated therewith by manufacturing the first vertical baffle 90 in which one half of the suction pipe 43 and one half of the vertical baffle 40 are integrated with each other, and manufacturing the second vertical baffle 92 in which the other half of the suction pipe 43 and the other half of the vertical baffle 40 are integrated with each other. Then, it is possible to couple the first vertical baffle 90 and the second vertical baffle 92 with each other. The baffle assembly 30 may be produced by inserting the vertical baffle 40 having the suction pipe 43 integrated therewith into the corresponding groove of the horizontal baffle 50, and then coupling the vertical baffle 40 and the horizontal baffle 50 with each other.

In another example, the suction pipe 43 may be produced by manufacturing one half of the suction pipe 43 and the other half of the suction pipe and then coupling the two halves with each other. In addition, the vertical baffle 40 may be produced by manufacturing one half of the vertical baffle 40 and the other half of the vertical baffle 40 and then coupling the two halves with each other. The vertical baffle 40 having the suction pipe 43 coupled thereto may then be produced by coupling the suction pipe 43 and the vertical baffle 40 with each other. In addition, the baffle assembly 30 may be produced by inserting the vertical baffle 40 having the suction pipe 43 coupled thereto into the corresponding groove of the horizontal baffle 50, and then coupling the vertical baffle 40 and the horizontal baffle 50 with each other.

The suction pipe 43 may include a suction pipe inlet 44 into which the gaseous refrigerant in the upper chamber 96 flows and a suction pipe outlet 45 discharging the gaseous refrigerant in the suction pipe 43 to the refrigerant outlet port 28. The suction pipe 43 may extend from the suction pipe inlet 44 to the suction pipe outlet 45.

The suction pipe inlet 44 may be disposed between the first and second grooves 80 and 82 in an upper portion of the upper chamber 96. The suction pipe inlet 44 may be disposed higher than the horizontal baffle 50 by a predetermined height to prevent the liquid refrigerant that is scattered when hitting the horizontal baffle 50 from flowing into the suction pipe inlet 44 and being moved to the compressor. At least a portion of the suction pipe inlet 44 may be covered by the guide 47. The guide 47 may be disposed around the suction pipe inlet 44 and may cover at least a portion of the suction pipe inlet 44, thereby impeding the liquid refrigerant from flowing into the suction pipe inlet 44. In addition, the guide 47 may guide the gaseous refrigerant in the upper chamber 96 to flow into the suction pipe inlet 44. The suction pipe inlet 44 may be disposed to be higher than the outlet end 27 of the refrigerant inlet port 26. The outlet end 27 of the refrigerant inlet port 26 may discharge the mixed refrigerant at a lower position than the suction pipe inlet 44 such that the liquid refrigerant among the mixed refrigerant may flow down due to gravity. It is thus possible to prevent the liquid refrigerant discharged from the outlet end 27 of the refrigerant inlet port 26 from flowing into the suction pipe inlet 44.

The suction pipe outlet 45 may be connected to a bottom surface of the second groove 82 in the upper portion of the upper chamber 96. As described above, the inlet end of the refrigerant outlet port 28 may be inserted into the second groove 82. In other words, the inlet end of the refrigerant outlet port 28 may be inserted into the suction pipe outlet 45, and the gaseous refrigerant discharged through the suction pipe outlet 45 may thus flow into the refrigerant outlet port 28 through the inlet end of the refrigerant outlet port 28. The gaseous refrigerant may then be transferred to the compressor through the outlet end of the refrigerant outlet port 28.

The suction pipe 43 may extend downward from the suction pipe inlet 44 to a lower portion of the lower chamber 97, and then extend upward again to the suction pipe outlet 45 in the upper chamber 96. Accordingly, the gaseous refrigerant flowing into the suction pipe 43 through the suction pipe inlet 44 may be moved from the upper chamber 96 to the lower chamber 97 and then again to the upper chamber 96 in the suction pipe 43.

An oil orifice 70 may be provided in a lower portion of the suction pipe 43 and communicate with the lower portion of the lower chamber 97. The refrigerant discharged from the evaporator may contain a certain amount of oil to ensure a smooth operation of the compressor. The refrigerant containing the oil may flow into the upper chamber 96 in the accumulator 10 through the refrigerant inlet port 26, flow into the lower chamber 97 through the filter 54 due to its high specific gravity, and gather in the lower portion of the lower chamber 97. As shown in FIG. 6, when the gaseous refrigerant is moved through the suction pipe 43, the oil gathered in the lower portion of the lower chamber 97 may be suctioned into the suction pipe 43 through the oil orifice 70 and mixed with the gaseous refrigerant. The gaseous refrigerant mixed with the oil may then be supplied to the compressor to prevent the compressor failure.

Hereinafter, an operation of the accumulator 10 according to an embodiment of the present disclosure is described.

As shown in FIG. 6, the mixed refrigerant evaporated from the evaporator may be discharged to the inclined surface 48 through the refrigerant inlet port 26. The mixed refrigerant may be dispersed into the chamber on one side and the chamber on the other side by the inclined surface 48. The liquid refrigerant among the mixed refrigerant may be moved downward by gravity, pass through the filter 54, and filter out the foreign material therefrom.

The gaseous refrigerant among the mixed refrigerant and the gaseous refrigerant evaporated from the liquid refrigerant in the lower chamber 97 may be moved to the upper chamber 96 by its specific gravity, and moved into the suction pipe 43 through the suction pipe inlet 44 disposed in the upper chamber 96. The gaseous refrigerant may be moved through the suction pipe 43, moved to the refrigerant outlet port 28 through the suction pipe outlet 45, and transferred to the compressor through the refrigerant outlet port 28.

In a process in which the gaseous refrigerant is moved through the suction pipe 43, the oil in the lower chamber 97 may be suctioned into the suction pipe 43 through the oil orifice 70 and mixed with the gaseous refrigerant. In addition, the gaseous refrigerant may exchange heat with the liquid refrigerant in the lower chamber 97. The gaseous refrigerant mixed with the oil may be transferred to the compressor to prevent compressor failure.

According to another embodiment of the present disclosure, a heat pump system is provided. The heat pump system includes the evaporator, the accumulator 10, and the compressor. The evaporator may evaporate the refrigerant and supply the same to the accumulator 10. The accumulator 10 may separate the gaseous refrigerant from the refrigerant and supply the same to the compressor. The compressor may compress the gaseous refrigerant. The gaseous refrigerant may pass through an additional component and then be moved again to the evaporator.

Although the embodiments of the present disclosure have been described hereinabove, the scope of the present disclosure is not limited thereto. All equivalent modifications easily made by those having ordinary skill in the art to which the present disclosure pertains are intended to fall within the scope and spirit of the present disclosure.

What is claimed is:

1. An accumulator comprising:

a body including an upper body disposed on an upper side and a lower body disposed on a lower side, the upper body and the lower body being coupled with each other to have a chamber in the body;

a refrigerant inlet port disposed on the upper body and configured to allow a mixed refrigerant of a liquid refrigerant and a gaseous refrigerant to flow into the chamber;

a refrigerant outlet port disposed on the upper body and configured to allow the gaseous refrigerant separated from the liquid refrigerant to flow out; and a baffle assembly disposed in the chamber, configured to impede a flow of the liquid refrigerant, and coupled to the body, wherein the baffle assembly further includes a vertical baffle vertically disposed in the chamber and configured to impede a horizontal flow of the liquid refrigerant, wherein the vertical baffle includes a vertical baffle plate having first and second grooves formed in an upper end portion, spaced apart from each other, and each having an open upper portion, and wherein the refrigerant inlet port is inserted into the first groove, and the refrigerant outlet port is inserted into the second groove.

2. The accumulator of claim 1, wherein the baffle assembly includes a horizontal baffle horizontally disposed in the chamber and configured to impede a vertical flow of the liquid refrigerant.

3. The accumulator of claim 2, wherein the horizontal baffle separates the chamber into an upper chamber and a lower chamber, and wherein a filter is disposed in the horizontal baffle and configured to filter foreign material in the refrigerant, the filter further configured to fluidly communicate the upper chamber with the lower chamber.

4. The accumulator of claim 3, wherein the baffle assembly further includes a suction pipe configured to guide the gaseous refrigerant separated from the liquid refrigerant to the refrigerant outlet port, and wherein the suction pipe includes a suction pipe inlet through which the gaseous refrigerant flows into the suction pipe, and a suction pipe outlet through which the gaseous refrigerant is discharged to the refrigerant outlet port, wherein the suction pipe inlet and the suction pipe outlet are disposed in the upper chamber, and wherein the suction pipe extends downward from the suction pipe inlet to the lower chamber, and extends upward again to the suction pipe outlet disposed in the upper chamber.

5. The accumulator of claim 4, wherein a guide is disposed around the suction pipe inlet and configured to prevent the liquid refrigerant from flowing into the suction pipe.

6. The accumulator of claim 4, wherein an outlet end of the refrigerant inlet port is disposed to be lower than the suction pipe inlet.

7. The accumulator of claim 4, wherein an oil orifice is provided at a lower portion of the suction pipe and configured to fluidly communicate with a lower portion of the lower chamber.

8. The accumulator of claim 3, wherein a desiccant is mounted on an upper surface of the horizontal baffle.

9. The accumulator of claim 3, wherein the horizontal baffle is coupled to a portion where the upper body and lower body are coupled with each other.

10. The accumulator of claim 2, wherein the baffle assembly further includes a suction pipe guiding the gaseous refrigerant separated from the liquid refrigerant to the refrigerant outlet port, and wherein the vertical baffle and the suction pipe are integrated with each other and coupled to the horizontal baffle.

11. The accumulator of claim 10, wherein the vertical baffle and the suction pipe are manufactured as first and second vertical baffles and then coupled with each other.

12. The accumulator of claim 1, wherein the baffle assembly further includes a suction pipe configured to guide the gaseous refrigerant separated from the liquid refrigerant to the refrigerant outlet port.

13. The accumulator of claim 1, wherein a bottom surface of the first groove includes an inclined surface.

14. The accumulator of claim 1, wherein the baffle assembly further includes a suction pipe guiding the gaseous refrigerant separated from the liquid refrigerant to the refrigerant outlet port, and wherein a bottom surface of the second groove is connected to the suction pipe, such that the suction pipe is inserted into the refrigerant outlet port.

15. The accumulator of claim 1, wherein the vertical baffle includes a vertical baffle plate, and wherein at least one through hole is formed in the vertical baffle plate.

16. The accumulator of claim 1, wherein the body and the baffle assembly are each made of plastic.

17. A heat pump system comprising:

an evaporator configured to evaporate a refrigerant;

an accumulator configured to receive a mixed refrigerant of a liquid refrigerant and a gaseous refrigerant from the evaporator, and separate the gaseous refrigerant from the mixed refrigerant; and a compressor configured to receive the gaseous refrigerant from the accumulator and compress the gaseous refrigerant, wherein the accumulator comprises:

a body including an upper body disposed on an upper side and a lower body disposed on a lower side, the upper body and the lower body being coupled with each other to have a chamber in the body;

a refrigerant inlet port disposed on the upper body and configured to allow a mixed refrigerant of a liquid refrigerant and a gaseous refrigerant to flow into the chamber;

a refrigerant outlet port disposed on the upper body and configured to allow the gaseous refrigerant separated from the liquid refrigerant to flow out; and a baffle assembly disposed in the chamber to impede a flow of the liquid refrigerant and coupled to the body, wherein the baffle assembly further includes a vertical baffle vertically disposed in the chamber and configured to impede a horizontal flow of the liquid refrigerant, wherein the vertical baffle includes a vertical baffle plate having first and second grooves formed in an upper end portion, spaced apart from each other, and each having an open upper portion, and wherein the refrigerant inlet port is inserted into the first groove, and the refrigerant outlet port is inserted into the second groove.

18. The heat pump system of claim 17, wherein the refrigerant inlet port is connected to the evaporator, and the refrigerant outlet port is connected to the compressor.

* * * * *